US006190246B1

(12) United States Patent
Parrott et al.

(10) Patent No.: US 6,190,246 B1
(45) **Date of Patent: *Feb. 20, 2001**

(54) SANDING DEVICES AND THE LIKE FOR REMOVING MATERIALS

(76) Inventors: Brian H. Parrott, 3 Camelot Court, Don Mills, Ontario (CA), M3B 2N4; Roger W. Mason, 23 Lacewood Crescent, Don Mills (CA), M3A 2Z3

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/773,629

(22) Filed: Dec. 23, 1996

(30) Foreign Application Priority Data

Dec. 13, 1996 (CA) ..... 2192880

(51) Int. Cl.[7] ..... B24D 11/02

(52) U.S. Cl. ..... 451/540; 451/535; 451/536; 57/293

(58) Field of Search ..... 451/526–530, 451/539, 527, 528, 529, 540, 41, 449, 296, 533–538, 356; 228/122.1; 125/15; 57/295

(56) References Cited

U.S. PATENT DOCUMENTS

| | | | | |
|---|---|---|---|---|
| 2,838,890 | * | 6/1958 | McIntyre | 451/527 |
| 2,997,437 | * | 8/1961 | Whitaker | 451/296 |
| 3,005,295 | * | 10/1961 | Tucker et al. | 451/536 |
| 3,034,267 | * | 5/1962 | Feeney | 451/557 |
| 3,145,511 | * | 8/1964 | Bird et al. | 451/449 |
| 3,173,231 | * | 3/1965 | Moyer | 451/523 |
| 3,259,959 | * | 7/1966 | Tobey | 451/449 |
| 3,754,359 | * | 8/1973 | Scandaletos | 451/449 |
| 3,860,400 | * | 1/1975 | Prowse et al. | 51/295 |
| 4,621,461 | * | 11/1986 | Martin | 451/523 |
| 5,131,193 | * | 7/1992 | Demers | 451/523 |
| 5,131,924 | * | 7/1992 | Wiand | 51/293 |
| 5,662,519 | * | 9/1997 | Arnold | 451/523 |
| 5,749,770 | * | 5/1998 | Uzumcu et al. | 451/356 |

OTHER PUBLICATIONS

Brochure, Printed in Canada by Dura–GRIT Inc., distributed end of Oct. 1996 and disclosing certain tools, some with perforated metal plate material.

* cited by examiner

*Primary Examiner*—David A. Scherbel
*Assistant Examiner*—George Nguyen
(74) *Attorney, Agent, or Firm*—Charles P. Boukus, Jr.

(57) ABSTRACT

Perforated sheet steel or wire mesh to which tungsten carbide grit is copper braze welded to provide a device which can be cut to a desired size and shaped into or used as a substrate for tools used for sanding, filing, grinding, deburring, deflashing, cutting, sawing, filing and the like. The sheet steel being perforated provides apertures or recesses wherein removed material can collect and/or pass through reducing the clogging of the grit and frequency of cleaning the working surface of the tool or device. The apertures also provide for the flow of air, cooling the device in certain applications. Tungsten carbide gritted wire mesh is particularly good in providing a surface which tends to renew itself due to grit adhering to the side of the wire strands but not such as to clog the holes. Welding the grit to the wire mesh or cloth also causes the strands of the cloth to be welded together providing for a strong, yet flexible device or substrate.

5 Claims, 5 Drawing Sheets

SANDING DEVICES AND THE LIKE FOR REMOVING MATERIALS

FIELD OF THE INVENTION

The invention relates to material used for or to provide for "sanding" surfaces, cutting, grinding, filing, shaping, deburring, deflashing, trimming or sawing articles and more particularly to tungsten carbide brazed perforated sheet steel and wire cloth or mesh for use on or as tools to achieve these varied operations. The word "sanding" herein is used generally to indicate the action of removing or the removal of material whether by sanding, cutting, grinding, filing, shaping, deburring, deflashing, trimming or sawing.

BACKGROUND OF THE INVENTION

The manufacture of sanding and shaping tools for use by hobbyists, do-it-yourselfers and others is well known. The manufacture of such tools using tungsten carbide particles or grit has also been done, the tool using tungsten carbide particles usually being sharper, longer lasting and superior in performance to ordinary or regular sandpaper. Solid sheet steel with tungsten carbide particles welded thereto is available in grit grades generally equivalent to sandpaper. Flexible sheet steel with tungsten carbide particles adhered thereto can be cut and shaped into various hand held tools.

The advantage of such material in tools over regular sandpaper include the material being sharper and providing cleaner cutting on a far more diverse range of materials. The life of the tool is longer and the grit particles do not tear loose as they do with regular sandpaper.

Tungsten carbide grit welding to steel, having been used to coat various steel grinding and shaping tools, is a known process, particularly in the auto tire and shoe leather industries. Welding tungsten carbide grit to relatively thin (0.010 inch) solid steel sheeting has provided a sandpaper-like product that can be bent or shaped and is consistent with other tungsten carbide coated tools in that the coated surface remains "sharp" over a relatively long period of time. When painted, the gritted solid steel sheet even resembles the look of regular sandpaper.

However, a drawback of the solid sheet steel with tungsten grit adhered thereto is that it tends to clog when working on softer materials because the material removed during the use of the device tends to form a layer or thin surface between the device and the article being worked on. This layer or thin surface of removed material clogs the grit material necessitating greater pressure between the device and article to continue effective and efficient removal of material and to overcome the detrimental effect caused by the build up of the layer. This is particularly so with "sanding" devices with fine grit particles. Not only is frequent cleaning of the surface of the device required but brushing a layer of fine removed material from the surface of the article may also be required in order to regain some of the efficiency of the working action, whether sanding, filing, grinding or the like.

It would be desirable to produce a sanding-type device or product which reduces the tendency for removed material to form the layer that lessens the cutting action of the grit particles and which reduces the tendency of the grit material to clog so quickly. A device or product which enhances the efficiency of the cutting action and requires less stoppages to clean the device and the surface of the article would be advantageous.

SUMMARY OF THE INVENTION

Accordingly we discovered after some trial, that perforations in the sheet steel to which the tungsten carbide grit is welded (copper brazed) significantly reduces the clogging of the grit and the formation of the layering effect.

More particularly, the gritted, perforated sheet steel has advantages over and is superior to the gritted, unperforated sheet steel and regular sandpaper. Removed material collects in the holes, thereby greatly reducing clogging of the grit. The removed material which collects in the holes is easily cleaned by tapping/ wrapping the sanding/shaping tool on a hard surface. In some tool applications, the removed material passes through the holes. Further, when the perforated sheet steel is gritted with tungsten carbide, some of the grit attaches to the perimeters of the holes on the vertical plane as it falls through the holes, as well as on the horizontal plane. As a tool with the perforated sheet steel is used and some wearing of grit occurs, grit pieces on the perimeter or the periphery of the holes on the vertical plane are revealed, thus providing new sanding/shaping surfaces. This is particularly so when wire mesh cloth is used as the substrate for the grit material.

Accordingly, the performance and efficiency of the device is enhanced significantly due to the additional cutting facets of the grit particles that fall into the edges of the holes in the sheet steel or wire mesh during the welding process and come into play as the other facets eventually wear down.

In summary, the tools which use the perforated sheet material are much less likely to clog, are much easier to clean and they last longer than the tools which use the unperforated sheet material.

In addition, the perforations help reduce overheating when the gritted perforated steel sheets are formed into rotary devices as the perforations cause heat to be dissipated more effectively from the device. Further, we have found that when incorporated into certain rotary forms of the tools, the perforations help cool the tool due to the passage of air at high speed through the perforations. Even when the rotary form has a backing as in the case of a disc sander, the perforations tend to create more air turbulence on the face of the tool which dissipates heat more readily. In addition, when the gritted material is used on vacuum power sanders such as orbital sanders, the residue is suctioned through the perforations into the bag or vacuum. Unlike some orbital sanding tools using sandpaper with a few large holes in a single concentric circle which have to be aligned with the vacuum holes in the platen of the tool, the discs developed according to the invention provide vacuum through any number of smaller holes whichever holes communicate with the larger pattern holes of the tool. The additional perforations also help to prevent clogging and aid in cooling. The above benefits are enhanced when perforated mesh gritted with the tungsten carbide is used.

Accordingly, the invention in one aspect pertains to an article of manufacture comprising perforated steel sheet having apertures therethrough and at least one surface having tungsten carbide grit material welded thereto. Preferably, the grit material is copper braze-welded to at least one surface and permeates at least the upper peripheral edge of at least some of the apertures, but without substantially restricting the apertures.

Another aspect of the invention pertains to an article of manufacture comprising steel wire cloth having tungsten carbide grit material copper brazed to at least one surface thereof, the grit material also penetrating the interstices of the wire cloth whereby the grit material adheres also to peripheral sides of the wire of the cloth but without completely restricting all of the apertures of the cloth.

Other aspects and advantages of the invention will become evident from the detailed description of preferred embodiments of the invention as set forth herein.

BRIEF DESCRIPTION OF THE DRAWINGS

FIG. 13 is a front view illustrating a large sanding disc for orbital sanders and the like.

DESCRIPTION OF PREFERRED EMBODIMENTS OF THE INVENTION

Figure 1A:
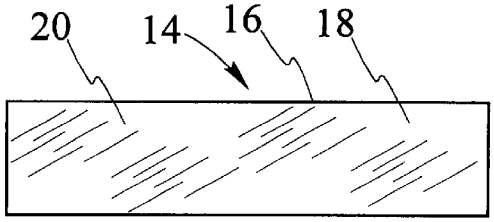
FIGS. 1*a*, 1*b* and 1*c* are top views respectively, illustrating the back surface, the front surface and an enlarged cross-sectional view, (along line 1*c*—1*c*), of a strip of known solid sheet material with grit material adhered thereto.
Figure 1B:
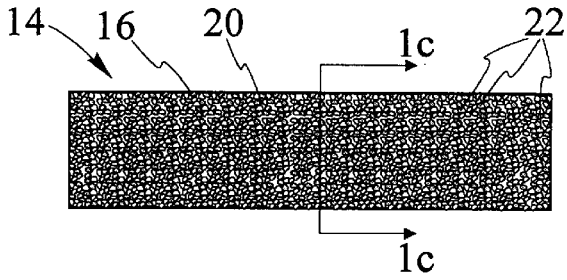
Figure 1C:
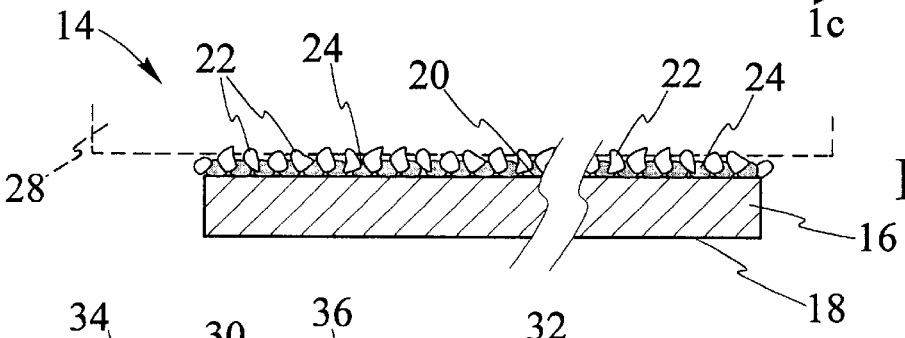

FIGS. 1*a*, 1*b* and 1*c* respectively illustrate a sheet of a sanding device 14 of thin sheet steel 16 with back surface 18 and front surface 20 with tungsten carbide grit or particles 22 adhered thereto. FIG. 1*c*, taken along line 1*c*—1*c* of FIG. 1*b* is an enlarged cross-sectional view for the purpose of illustration and clarity and shows tungsten carbide grit 22 copper brazed or welded to front surface 20 of sheet steel 16, the copper being designated as 24. When device 14 is used to "sand" an article, (or in a tool used for sanding an article), as shown outlined in dot-dash lines 28, (the word "sand" and like words "sanding" and "sanded" being used generically to mean removal of material by contact and relative movement between a device and an article from which material is to be removed by a "sanding" action), material removed from article 28 tends to form a film or layer on the surface 20 and clog the grit particles 22. As the layer builds up, it reduces the effectiveness of the sanding action and greater pressure is required between the device 14 and article 28 to effect appropriate material removal. Eventually, the sanding device 14 must be shaken, tapped on a surface or brushed to remove material clogging the grit. Further, the surface of the article 28 from which material is removed must also often be brushed or wiped to remove the fine layer residing on such article.

Figure 2A:
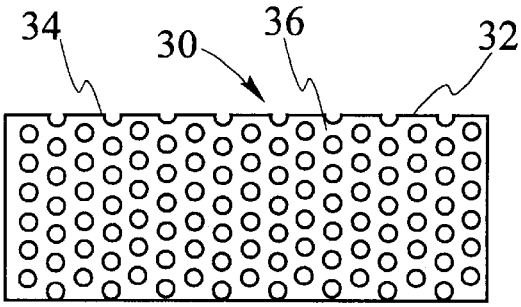
FIGS. 2*a*, 2*b* and 2*c* are top views respectively, illustrating the back surface, the front surface and an enlarged cross-sectional view, (along line 2*c*—2*c*), of a perforated strip of material with grit material adhered to the front surface according to one aspect of the invention.
Figure 2B:
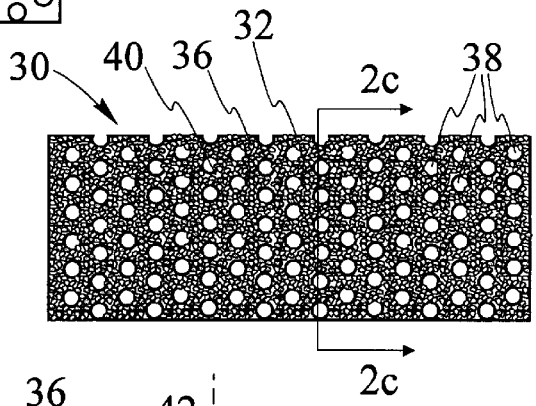
Figure 2C:
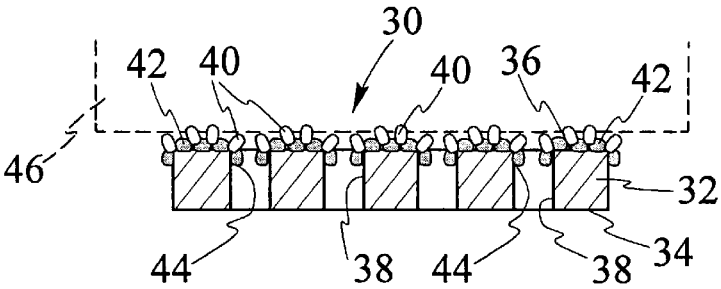

FIGS. 2*a*, 2*b* and 2*c* illustrate sanding device 30 of sheet steel 32 with back surface 34 and front surface 36 and having perforations 38 therethrough (1/16" perforations on 1/8" staggered centres). Tungsten carbide grit material or particles 40, (about 46–240 grit), are copper brazed or welded via copper 42 to front surface 36, as more particularly shown in FIG. 2*c*.

Perforations 38 permit collection of cut or removed material and permit passage of air and cut materials in some applications. It will be noted that grit material 40 not only adheres to the sheet front surface 36, but also adheres to the upper peripheral edge 44 of each perforation 38. Again FIG. 2*c* is not to scale with the grit material or particles 40 being shown much larger than normal, for purposes of clarity. Nevertheless, as device 30 is used, cut material or material removed from article 46 shown in dot-dash lines tend to be pushed into and fill perforations 38. The depth of the perforations relative the depth of the grit material causes a significant amount of material to fill the perforations. Further, the surface of the device has a series of interruptions caused by the perforations and thus the tendency of the cut or removed material to layer on surface 34 is reduced significantly. The effectiveness and efficiency of the device is therefore enhanced with only very periodic cleaning action such as tapping the device on a surface to clean out the perforations and remove cut material from the gritted surface.

Figure 3A:
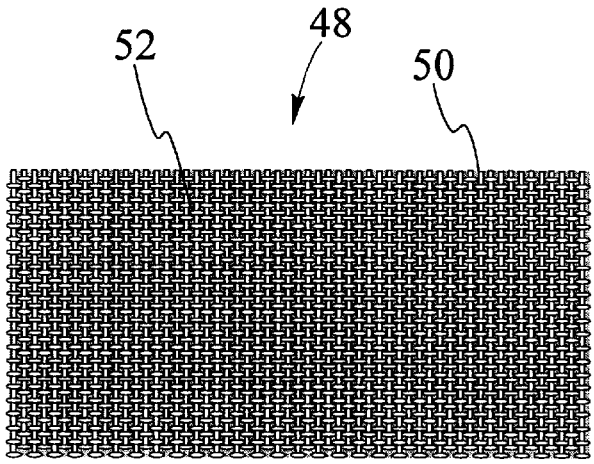
FIGS. 3*a*, 3*b* and 3*c* are top views respectively, illustrating the back surface, the front surface and an enlarged cross-sectional view, (along line 3*c*—3*c*), of a wire cloth with grit material adhered to the front surface according to another aspect of the invention.
Figure 3B:
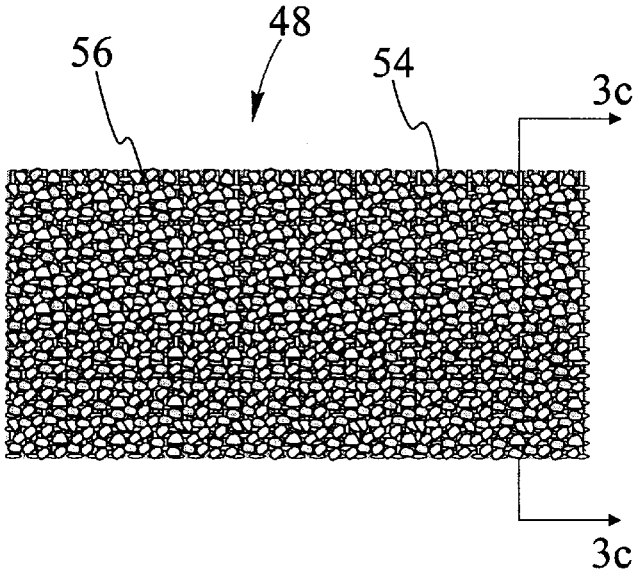
Figure 3C:
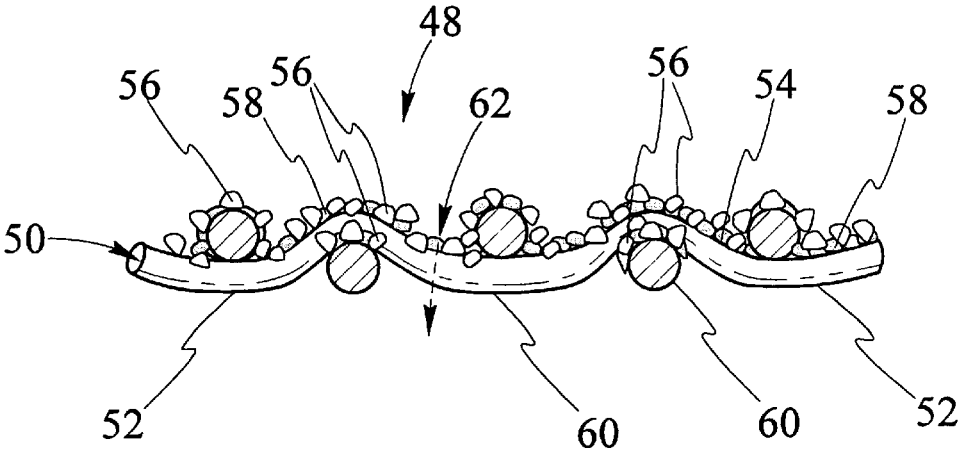

FIGS. 3*a*, 3*b* and 3*c* illustrate a further embodiment of the invention wherein device 48 is formed from wire mesh 50 and has back surface 52 and front surface 54. An enlarged cross-sectional view of wire cloth or mesh 50 is shown in FIG. 3*c*, (the mesh in FIGS. 3*a* and 3*b* being 40 mesh). Particles 56 of tungsten carbide, (about 80–240 grit), are copper brazed or welded to the front surface 54 of mesh 50. As more particularly shown in FIG. 3*c* on an enlarged scale for purposes of illustration and clarity, the particle or grit material 56 is copper welded, (the copper being designated as 58), not only to upper or front surface 54 of the wire cloth but also is welded to the peripheral sides of the wire or strands 60 of the cloth in the interstices or openings 62. This is significant since it provides additional new grit surfaces as other surfaces wear down. Further, the copper braze-welding also causes the mesh strands to be secured or welded together at their various points of intersection. This retards fraying of the cloth while still maintaining its flexibility and ability to be shaped into desired shapes.

Figure 4A:
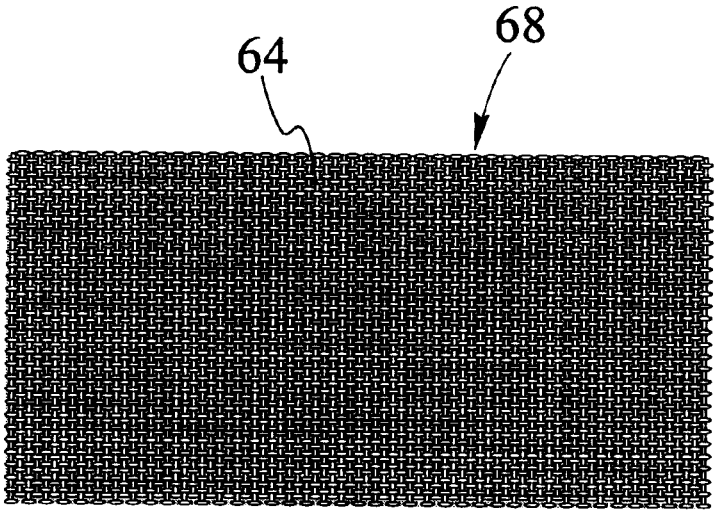
FIGS. 4*a* and 4*b* are top views, respectively, illustrating the back surface and front surface of finer mesh wire cloth, according to another aspect of the invention.
Figure 4B:
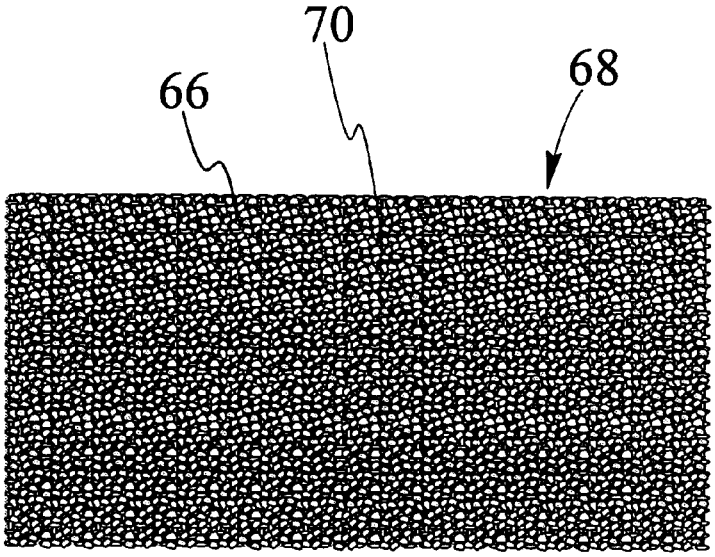

FIGS. 4*a* and 4*b* illustrate the back surface 64 and front surface 66 of wire cloth 68 of about 60 mesh, with tungsten carbide grit particles 70 of about 120–240 grit on the front surfaces. Grit 70 adheres to the wire of the cloth surfaces not only on the top of the wires but also on the sides of the wire strands within the interstices, similarly as that shown previously in FIG. 3*c*.

Tungsten carbide grit coated wire cloth or mesh have additional advantages over tungsten carbide grit coated perforated sheet steel. There is superior flexibility and the wire cloth can be formed and shaped either in the manufacturing process or by end users. The end users can shape the cloth or mesh into their own forms for use as hand sanders or with power tool sanding devices.

The less material density provided by the wire mesh embodiment allows for easier formation of forms or shapes of the material into tools since the finer mesh may be cut with household scissors. The mesh is also significantly lighter to use.

During manufacture of sheet steel and wire cloth according to the invention, grit flows in the molten copper around the upper holes in the sheet steel and between the wire matrix. This further lengthens the cutting life of rotary and non-rotary tools as new grit with sharper facets appear on the cutting surface as the grit wears down.

As noted before with respect to the wire cloth, the intersectional points of the wire cloth are effectively welded together which reduces and retards fraying of the mesh without sacrificing flexibility. Cutting the wire mesh into sheets is therefore also easier due to the solid intersectional points, making a more useable product.

The wire mesh or cloth embodiment has been found to be particularly suitable and effective for use on vacuum drywall sanders. The vacuum drywall sanders presently in use, use a coarse grid fiberglass screen with grit material glued thereon. This prior art screen readily cracks and grit breaks loose. The wire mesh embodiment of this invention lasts longer and is found to be superior in the sanding of drywall.

With respect to the manufacture of the perforated sheets and wire cloth of this invention, the steel, mesh or cloth used must be susceptible to the copper brazing of tungsten carbide thereon and as such should be a carbon steel, generally known as mild steel. Stainless steel is not suitable for gritting. The perforated sheets or wire mesh are coated with a copper paste and then the appropriate sized tungsten carbide grit is sprinkled on the sheet or mesh.

An even dispersion of the grit is significant to the performance of the material and the tools with which it is incorporated. Preferably, the grit is applied by a mechanical shaker which resembles a waterfall. More particularly, the grit tumbles over the edge of a vibration platen as the copper paste coated sheet(s) or wire cloth pass underneath at a speed dictated by the percentage of grit dispersion desired.

Sheets or cloth coated with copper paste and dispersed grit are then passed to a furnace on a ceramic spacer for a predetermined time depending on grit size, the number of sheets and sheet thickness. The sheets are evenly heated in an oxygen free furnace to a point or temperature whereby the copper paste becomes molten sufficiently, about 2040° F., so that the tungsten grit particles sit on the surface of the copper moistened steel. Grit particles are held by the molten copper to the edge of the apertures or the curved surfaces of strands of wire cloth. The sheets are withdrawn from the furnace and upon cooling, the particles are formally welded or brazed to the surface of the perforated sheet and/ or cloth and around the upper portion of the edge of the holes in the sheet or cloth. However, the grit does not significantly restrict the openings.

During the heating and cooling process, the sheets or wire cloth tend to twist so the cooled sheets and cloth are rolled flat and may be spray painted with an enamel with a color that may resemble sandpaper. Then the sheets or cloth are cut into appropriate shapes and sizes to suit the tools for which they will be attached or with which they will be associated. The perforated sheet steel and heavy mesh cloth can be cut by laser beam. However, the cloth may be cut by mechanical cutters and the fine mesh cloth can be cut by household shears or scissors, a definite advantage for modellers and hobbyists.

The thickness of the perforated sheet steel can vary depending on the application and tool for which it is designed. Thicknesses from 0.010" to 0.025" have been used with good results. The perforations we have found particularly good are 1/16" diameter holes on 1/8" staggered centers on a sheet of 0.024" thick sheet steel, there being 74 holes per square inch with 22.5% open area. Applicant has also found sheet steel with 0.027" diameter holes in straight row—centers with 23% open area to be effective. However, staggered holes are preferred in the sheet steel embodiment. Untreated perforated sheets of steel are commercially available.

The grit grades of tungsten carbide that are commercially available are substantially equivalent to those grits used for sandpaper, such as 46, 60, 80, 120 and 240 and the like. With increases in grit size, the hole size and hole centres are also increased. Coarse grit is used with larger diameter holes on greater centres between the holes, the preference being to use staggered centers to eliminate or reduce the possibility of striations on the surface being sanded.

With respect to the mesh cloth or screen embodiment, the degree of fineness of the cloth is directly proportional to the grit grade of tungsten carbide being used or applied to it. For example, 240 grit is preferably applied to about 80 mesh, (0.0055 gauge the finest range), whereas 120 grit is preferably applied to cloth of 60 (0.0075 gauge) mesh. On a 1/4" mesh, 10 grit can be used without substantially restricting the apertures in the mesh.

The perforated steel sheet or wire cloth can then be secured by gluing or by two-way adhesive tape or by other equivalent means to various forms of tools to form "sanding" devices.

Turning to FIGS. 5 to 14, various tools are shown with which the inventive perforated steel sheet and wire cloth with copper brazed tungsten carbide grit material may be used or various embodiments of tools into which the material may be formed.

Figure 5:
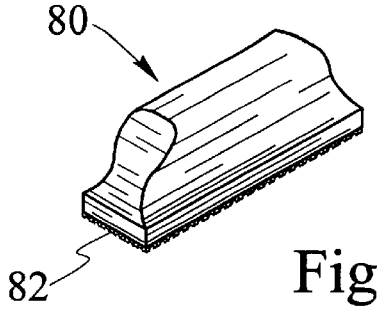
FIGS. 5, 6 and 7 are perspective views respectively, illustrating "sanding" tools having different shaped tool surfaces, namely, flat (FIG. 5), convex (FIG. 6) and concave (FIG. 7), with working material according to the invention.
Figure 6:
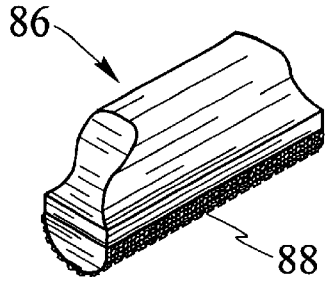
Figure 7:
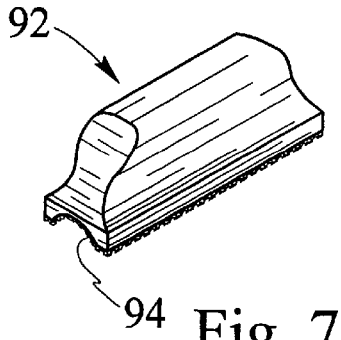

FIG. 5 illustrates a hand sanding device 80 (a flat mini-sander) to which flat perforated sheet steel 82 with copper brazed tungsten grit has been glued. FIG. 6 illustrates a hand sanding device 86 to which a curved perforated sheet steel 88 with copper brazed tungsten grit has been glued to provide a convex block sander. FIG. 7 illustrates a hand sanding device 92 to which curved perforated sheet steel 94 with copper brazed tungsten grit has been glued to provide a concave mini-sander. Wire mesh in accordance with the embodiments of FIGS. 3*c* and 4*b* can be used instead of the sheet steel.

Figure 8:
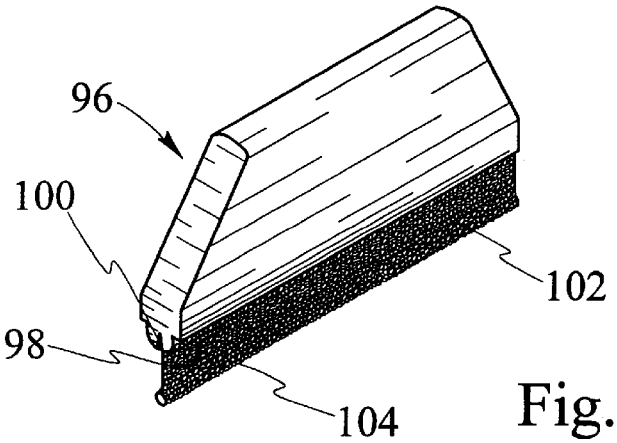
FIG. 8 is a perspective view illustrating a blade sander with small radius sanding edge.

FIG. 8 illustrates a hand sanding device 96 to which an upper edge (not shown) of perforated sheet steel 98 has been glued in slot 100. The surface 102 of the sheet steel is coated with tungsten carbide material and the other edge 104 of the sheet steel 98 has been curved into a tubular, cylindrical shape to provide a blade sanding device which will also do small curved or grooved surfaces. Wire mesh can be used in place of the sheet steel 98, the wire mesh having sufficient rigidity to provide a good sanding device but flexible enough to be easily formed into desired shaped curves.

Figure 9:
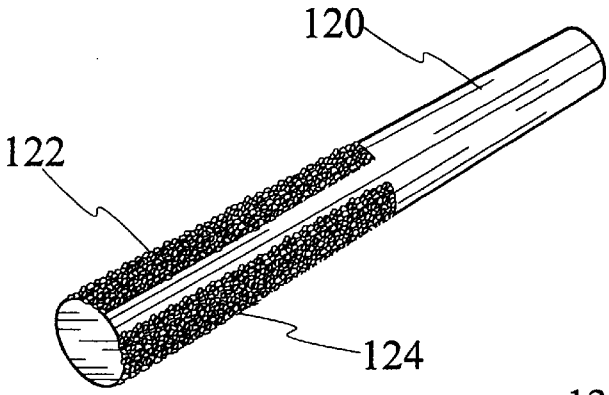
FIG. 9 is a perspective view illustrating a double grit round sanding tool.

FIG. 9 illustrates a round sander comprising dowelling 120 to which two curved perforated steel sheets 122, 124 with tungsten carbide grit thereon are glued.

Figure 10:
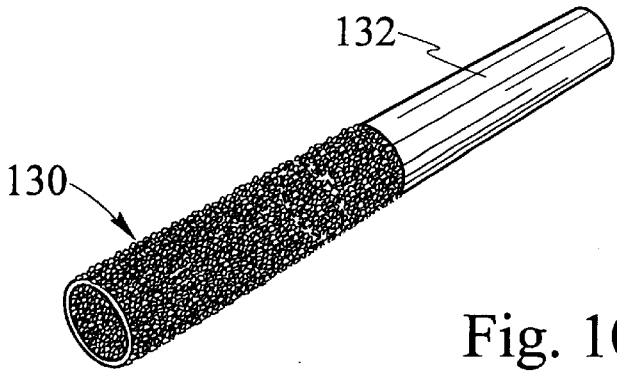
FIG. 10 is a perspective view illustrating a hollow double grit round sanding tool of gritted perforated material.

FIG. 10 illustrates a perforated hollow annular member 130 with its surface gritted. Member 130 has dowel handle 132 secured to one end. Any removed material falls into the hollow tube, thereby almost completely eliminating any clogging. There are also "renewed" sanding/shaping surfaces where the grit attaches to the inner vertical plane of the holes, as described earlier.

Figure 11:
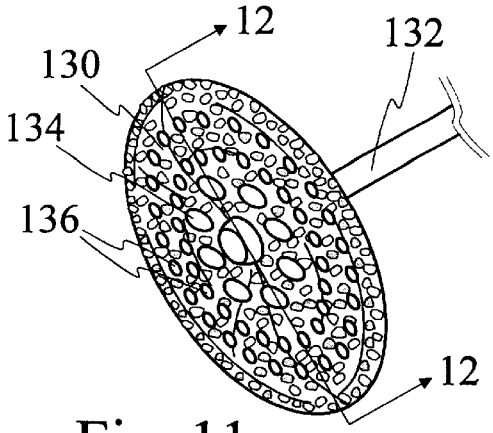
FIG. 11 is a perspective view illustrating a mushroom shaped small sanding disc on a mandrel, the disc being of perforated sheet steel having different sized perforations.
Figure 12:
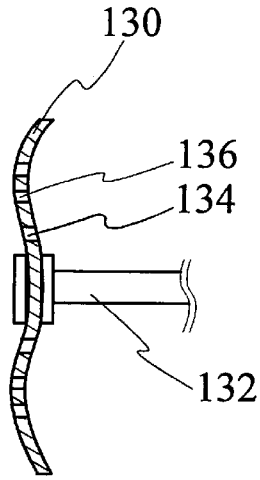
FIG. 12 is a sectional view of the disc sander of FIG. 11 taken along line 12—12 thereof.

FIG. 11 illustrates a mini disc sander with disc 130 of circular steel sheet having varying sized perforations on mandrel 132. FIG. 12 shows the disc 130 in cross-section to illustrate the mushroom-shape to this mini disc sander. Holes 134 are 1/8" in diameter and are primarily to reduce the weight of the disc as well as to facilitate the shaping of the disc into the mushroom shape. The smaller holes 136, about 1/32", are the perforations which not only lighten the disc, but are the working holes in use. Holes 136 permit air flow which cools the disc in use. It will be apparent that grit could be welded to both sides of disc 130 and on the peripheral edge which would provide for a cutting action to the disc when used on the edge.

Figure 13:
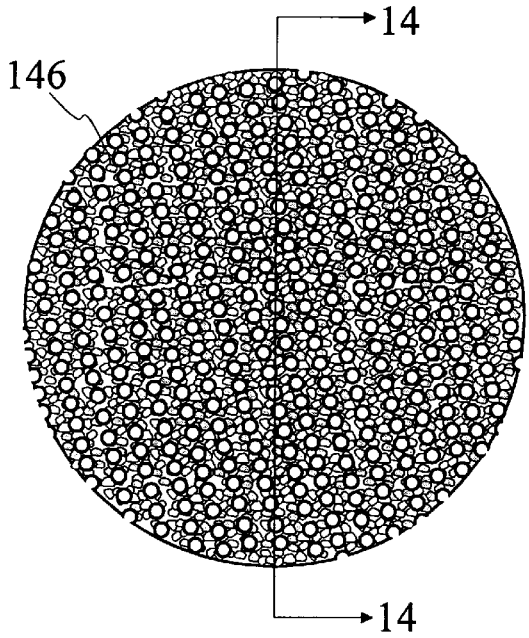
Figure 14:
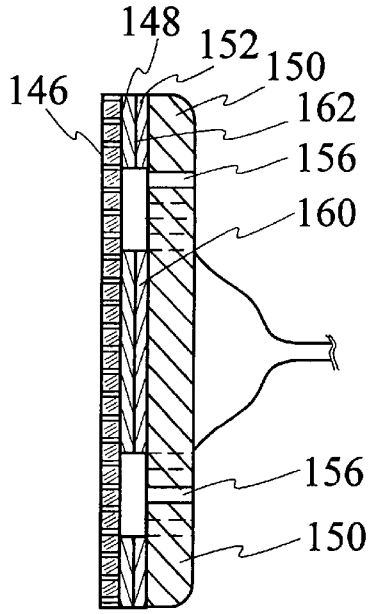
FIG. 14 is a sectional view taken along line 13—13 of FIG. 13.

FIGS. 13 and 14 illustrate a rigid steel sheet 146 disc sander backed by and secured to one portion of material 148 such as that marketed under the trade mark VELCRO. The sander disc 146 is secured to a motorized rotary platen 150 having compatible VELCRO material portion 152 affixed thereto by pressure adhesive. The sander disc 146, as may all the devices embodying the perforated sheet steel or wire mesh with tungsten carbide grit braze welded thereto, can be used to deburr, deflash, grind and sand, composites, fiberglass, ceramics, foam material, rubber, wood and the like.

The disc sander can be about ¼ inch to 12 inches in diameter and is secured to the platen by solid VELCRO or the like material which facilitates the ease with which discs of varying grits may be changed. The disc sander shown in FIGS. 13 and 14 is from 4 ½ inches to 6 inches in diameter and has a central disc of VELCRO 160 with a peripheral piece 162 of about 1 ½ inches (doughnut design). A radial space of about ½ inch provides an opening for some of the holes in the disc to align with those holes 156 in the rotary platen 150 which holes are connected with a vacuuming device or the like, (not shown).

Accordingly, the disc sander of gritted perforated sheet steel runs cooler because of the air cooling through the multiple holes, this results in less chance of the VELCRO backing coming loose, as well as less chance of burning wood or melting plastic parts/objects being worked on. The holes reduce the weight of the disc (compared with a solid sheet steel disc with only enough holes to align with the holes on the platen of the disc sander motor housing), which permits the user to operate the device at higher speeds, which results in accomplishing the intended work in less time, in addition to running at faster speeds (on devices that have a variable speed control), the user can apply more pressure to the object being worked on, which also reduces the time to accomplish the task. The disc sander with the perforated material requires no alignment with the holes on the platen of the motor housing, since there will be small perforated holes at any position on the disc in order to match the large (vacuum) holes on the platen of the motor housing.

Mesh material has even more advantages over the perforated sheet material, on certain tools. For example, with the disc sander of FIGS. 13 and 14, the mesh material has all the advantages/features described above with the perforated sheet material, but it lasts even longer than the perforated sheet material because the "renewed" sanding/shaping surfaces are much more prevalent with the mesh because of the mesh structure and the additional surface area covered by the grit. The gritted mesh disc sander also weighs less than a perforated sheet steel disc sander and hence reduces centrifugal forces thereby lessening the possibility of undesired vibrations.

The sander shown in FIG. 8 as noted above is another example of how mesh can be used, the mesh material is much more effective than the unperforated sheet material and still noticeably more effective than the perforated material in this application, due to the very small holes needed with the very small diameters involved, it is only possible to provide adequate "openings" by using the mesh material (the object being worked on therefore ends up with a better/smoother finish in less time and the tool stays sharper longer because of the "renewing effect" described earlier).

With the smaller tools such as those shown in FIGS. 5, 6 and 7, the mesh material has an advantage even over the perforated material, again because of the small diameters being used—the mesh material does not clog as easily, is easier to clean and lasts longer.

Accordingly, there has been set forth an advance in the art of providing tools with enhanced efficiency in cutting, flexibility and yet strong and ones which reduce clogging and operate at a cooler temperature when associated with a motorized operating tool.

I claim:

1. A sanding device comprising:

a flexible sheet of steel wire cloth capable of being manually shaped into a self-supporting configuration comprising a plurality of interwoven, intersecting strands of metal, each strand having a circular cross section providing a top portion and upper peripheral curved sides, said intersecting strands defining a plurality of openings adjacent to the intersections of said strands and said sheet having first and second opposed surfaces;

at least one of said surfaces having tungsten carbide grit material copper brazed thereto wherein said grit material adheres to the top portion of the circular wire strands and to a portion of the upper peripheral curved sides of the wire strands of the cloth adjacent to said openings, and said strands are welded together at the intersections of the strands as a result of the grit material being brazed to said strands.

2. The sanding device of claim 1 comprising wire cloth of 60 mesh with 120 grit tungsten carbide grit material.

3. The sanding device of claim 1 comprising wire cloth of 80 mesh with 240 grit tungsten carbide grit material.

4. The sanding device of claim 1 formed into a rotary disc backed by means to detachably secure the disc to a platen of a rotary sander.

5. The sanding device of claim 1 secured to means forming a handle for the device.

* * * * *